US009833827B2

(12) United States Patent
Kobayashi et al.

(10) Patent No.: US 9,833,827 B2
(45) Date of Patent: Dec. 5, 2017

(54) STAMPING DEVICE AND STAMPING METHOD

(71) Applicant: Roland DG Corporation, Hamamatsu-shi, Shizuoka (JP)

(72) Inventors: Kouichi Kobayashi, Hamamatsu (JP); Tsutomu Kuno, Hamamatsu (JP); Yoshihiro Yazawa, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 214 days.

(21) Appl. No.: 14/672,310

(22) Filed: Mar. 30, 2015

(65) Prior Publication Data

US 2015/0286207 A1 Oct. 8, 2015

(30) Foreign Application Priority Data

Apr. 8, 2014 (JP) ..... 2014-079138

(51) Int. Cl.

| | |
|---|---|
| ***B21D 22/02*** | (2006.01) |
| ***B44B 5/00*** | (2006.01) |
| ***B44B 3/00*** | (2006.01) |
| ***B41J 3/38*** | (2006.01) |
| *B44C 1/24* | (2006.01) |

(52) U.S. Cl.

CPC ..... *B21D 22/02* (2013.01); *B41J 3/385* (2013.01); *B44B 3/009* (2013.01); *B44B 5/0019* (2013.01); *B44B 5/0052* (2013.01); *B44C 1/24* (2013.01)

(58) Field of Classification Search

CPC ..... B41J 3/385; B44B 5/0052; B44B 5/0019; B44B 3/009; B44C 1/24; B21D 22/02

See application file for complete search history.

(56) References Cited

U.S. PATENT DOCUMENTS

2005/0086816 A1* 4/2005 Siegel ..... B44B 5/0095 33/18.1
2007/0000299 A1* 1/2007 Kuno ..... B44B 3/005 72/446
2011/0168039 A1* 7/2011 Kuno ..... B44B 3/063 101/3.1

* cited by examiner

*Primary Examiner* — R. K. Arundale
*Assistant Examiner* — Mohammad Yusuf
(74) *Attorney, Agent, or Firm* — Keating & Bennett, LLP

(57) ABSTRACT

A stamping device includes a stamping data generator configured to create stamping data to form a stamp image on a surface of a processing target, a positioning data generator configured to create positioning data to position the processing target, and a controller configured or programmed to control an operation of the processing tool. The controller includes a first controller configured or programmed to control the processing tool such that stamping is performed, based on the positioning data at a first stamping energy, on the processing target including a protective sheet attached thereto in a predetermined area including a stamping area where the stamp image is to be formed, and a second controller configured or programmed to control the processing tool such that stamping is performed, based on the stamping data at a second stamping energy equal to or different from the first stamping energy, on the processing tool in a state of having the protective sheet peeled off therefrom.

9 Claims, 4 Drawing Sheets

STAMPING DEVICE AND STAMPING METHOD

The present application claims priority from Japanese Patent Application No. 2014-079138 filed on Apr. 8, 2014, which is incorporated by reference herein in its entirety.

BACKGROUND OF THE INVENTION

1. Field of the Invention

The present invention relates to a stamping device and a stamping method that forms a desired stamp image on a surface of a processing target by stamping.

2. Description of the Related Art

Conventionally, a stamping device is known that forms a desired image, for example, a photo image, a two-dimensional symbol or the like by forming a plurality of dot-shaped stamping indentations on a surface of a processing target formed of, for example, a metal material that is plastically deformable relatively easily such as gold, platinum, brass, aluminum, stainless steel or the like, or a resin material such as acrylic resin or the like. An example of the two-dimensional symbol is a two-dimensional code including squares called "cells" arrayed in a matrix; specifically, a QR code (registered trademark), a data matrix or the like. Such a stamping device stamps a tip of a needle-shaped processing tool on a surface of a processing target secured by a securing jig, so that a plurality of dot-shaped stamping indentations are formed on the surface.

A two-dimensional symbol is formed on a surface of a steel tool for medical uses such as, for example, a knife, a clamp or the like by use of such a stamping device as follows. First, the steel tool for medical uses, on which the two-dimensional symbol is to be formed, is secured to a securing jig while being positioned. Then, various settings are made regarding the stamping force by which stamping is to be performed on the surface of a processing target (more specifically, the steel tool for medical uses described above) by a processing tool, the size of an image to be formed by the stamping (stamp image) and the like. After the settings, data used to perform the stamping (stamping data) is created based on data representing the two-dimensional symbol and the various settings that have been input to, for example, a microcomputer of the stamping device. When an instruction is issued to perform the stamping on the processing target, a stamping head having the processing tool attached thereto is controlled by the microcomputer so that the stamping is performed on the surface of the processing target. Thus, a stamp image such as the two-dimensional symbol is formed on the surface of the processing target. The processing target is positioned by fine-adjusting the position of the securing jig or the position of the processing target such that a central position of an area of the surface of the processing target on which the stamp image is to be formed is irradiated with light from a laser pointer.

However, with the above-described conventional stamping device, even when the processing target is positioned by use of a laser pointer or the like, there are cases where the stamp image such as the two-dimensional symbol is not formed at an appropriate position on the surface of the processing target. More specifically, there are cases where the stamp image extends beyond a desired stamping area, or the shape of the stamp image is distorted and thus cannot be recognized.

When the stamp image cannot be formed inside the desired stamping area, the surface of the processing target having the stamp image formed thereon is ground by a grinder or the like to erase the stamp image. Then, the processing target is positioned again, and the stamp image such as the two-dimensional symbol or the like is formed again. Until the stamp image is formed inside the desired stamping area, the above-described process of positioning of the processing target, performing the stamping, and erasing the stamp image is repeated. An unexperienced operator often performs such a process repeatedly. This is time-consuming and often decreases the operation efficiency.

SUMMARY OF THE INVENTION

Preferred embodiments of the present invention provide a stamping device and a stamping method allowing even an unexperienced operator to easily perform stamping on a processing target.

A stamping device according to a preferred embodiment of the present invention performs stamping on a surface of a processing target. The stamping device includes a processing tool located to be movable at least upward and downward; a stamping data generator configured to create stamping data usable to form a stamp image on the surface of the processing target, based on image data corresponding to the stamp image; a positioning data generator configured to create positioning data usable to position the processing target, based on the stamping data; and a controller configured or programmed to control an operation of the processing tool. The controller includes a first controller configured or programmed to control the processing tool such that stamping is performed, based on the positioning data at a first stamping energy, on the processing target in a state of having a protective sheet attached thereto, the protective sheet being attached to a predetermined area including a stamping area where the stamp image is to be formed; and a second controller configured or programmed to control the processing tool such that stamping is performed, based on the stamping data at a second stamping energy which is equal to or different from the first stamping energy, on the processing tool in a state of having the protective sheet peeled off therefrom.

The positioning data represents a plurality of stamping indentations for positioning on an outermost line of the stamping area.

The stamping area is square or rectangular, and the image data represents a two-dimensional symbol that is to be formed in the stamping area; the stamping data generator configured or programmed to create the stamping data based on the image data representing the two-dimensional symbol; and the positioning data generator configured or programmed to create positioning data representing a plurality of stamping indentations for positioning on a horizontal line in the stamping area and a plurality of stamping indentations for positioning on a vertical line that is vertical to the horizontal line and is in the stamping area.

The positioning data generator is configured or programmed to create positioning data representing a plurality of stamping indentations for positioning on each of outermost horizontal lines in the stamping area and a plurality of stamping indentations for positioning on each of outermost vertical lines in the stamping area.

The positioning data generator is configured or programmed to create positioning data representing a stamping indentation for positioning at each of four corners of the stamping area, at least one stamping indentation for positioning on the horizontal line extending from each of the corners and at least one stamping indentation for positioning on the vertical line extending from each of the corners, the at least one stamping indentation for positioning on the horizontal line and the at least one stamping indentation for positioning on the vertical line being of the same number.

A total number of the stamping indentation for positioning at each of the corners, the at least one stamping indentation for positioning on the horizontal line extending from the each corner and the at least one stamping indentation for positioning on the vertical line extending from the each corner is seven.

The first controller is configured or programmed to control the processing tool such that the stamping is performed on the protective sheet but not on the processing target, based on the positioning data.

The protective sheet is softer than the processing target.

The protective sheet is made of a synthetic resin transparent adhesive tape.

The processing target is a steel medical tool.

A stamping method according to another preferred embodiment of the present invention performs stamping on a surface of a processing target by use of a processing tool movable at least upward and downward. The method includes a stamping data creation step of creating stamping data usable to form a stamp image on the surface of the processing target, based on image data corresponding to the stamp image; a positioning data creation step of creating positioning data usable to position the processing target, based on the stamping data; an attaching step of attaching a protective sheet to a predetermined area on the processing target that includes a stamping area where the stamp image is to be formed; a positioning step of controlling the processing tool such that stamping is performed, based on the positioning data at a first stamping energy, on the processing target in a state of having the protective sheet attached thereto; and a peeling step of peeling off the protective sheet from the processing target; and a stamping step of controlling the processing tool such that stamping is performed, based on the stamping data at a second stamping energy which is equal to or different from the first stamping energy, on the processing tool in a state of having the protective sheet peeled off therefrom.

The positioning data represents a plurality of stamping indentations for positioning formed on an outermost line of the stamping area.

The stamping area is square or rectangular, and the image data represents a two-dimensional symbol that is to be formed in the stamping area; in the stamping data creation step, the stamping data is created based on the image data representing the two-dimensional symbol; and in the positioning data creation step, positioning data is created representing a plurality of stamping indentations for positioning formed on a horizontal line in the stamping area and a plurality of stamping indentations for positioning formed on a vertical line that is vertical to the horizontal line and is in the stamping area.

In the positioning data creation step, positioning data is created to represent a plurality of stamping indentations for positioning formed on each of outermost horizontal lines in the stamping area and a plurality of stamping indentations for positioning formed on each of outermost vertical lines in the stamping area.

In the positioning data creation step, positioning data is created to represent a stamping indentation for positioning formed at each of four corners of the stamping area, at least one stamping indentation for positioning formed on the horizontal line extending from each of the corners and at least one stamping indentation for positioning formed on the vertical line extending from each of the corners, the at least one stamping indentation for positioning formed on the horizontal line and the at least one stamping indentation for positioning formed on the vertical line being of the same number.

Seven of the stamping indentations for positioning are created as a total of the stamping indentation for positioning formed at each of the corners, the at least one stamping indentation for positioning formed on the horizontal line extending from the each corner and the at least one stamping indentation for positioning formed on the vertical line extending from the each corner.

In the positioning step, the stamping is performed on the protective sheet but not on the processing target, based on the positioning data.

A material softer than the processing target is used for the protective sheet.

A synthetic resin transparent adhesive tape is used for the protective sheet.

A medical steel tool is the processing target.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
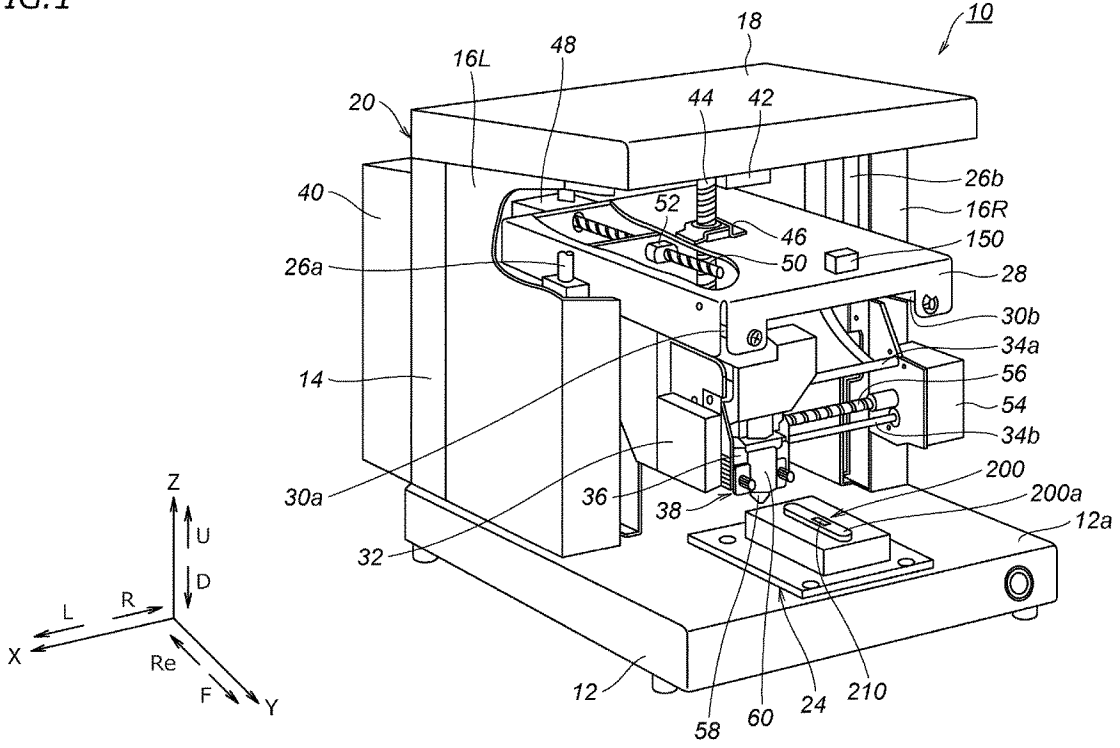
FIG. 1 is a partially cut perspective view of a stamping device in a preferred embodiment according to the present invention.

Hereinafter, preferred embodiments of the present invention will be described with reference to the drawings. As shown in FIG. 1, X axis, Y axis and Z axis are perpendicular to one another. In FIG. 1, L refers to the left side of the X axis and R refers to the right side of the X axis. F refers to the front side of the Y axis and Re refers to the rear side of the Y axis. U refers to the up side of the Z axis and D refers to the down side of the Z axis. A stamping device 10 is placed on a plane defined by the X axis and the Y axis. The left side and the right side of the X axis are as seen from a person facing the stamping device 10. The front side of the stamping device 10 that is defined by the Y axis is the side on which a processing target 200 is secured. These directions are defined merely for the sake of explanation, and do not limit in any way the form of installing the stamping device 10 according to various preferred embodiments of the present invention.

As shown in FIG. 1, the stamping device 10 in this preferred embodiment of the present invention preferably includes a housing 20. The housing 20 includes a base member 12, a rear member 14, a side member 16L, a side member 16R, and a top member 18. The rear member 14 is arranged vertically or substantially vertically on a rear portion of a top surface 12*a* of the base member 12. The side member 16L is secured to the rear member 14 and is arranged vertically or substantially vertically on a left portion of the base member 12. Similarly, the side member 16R is secured to the rear member 14 and is arranged vertically or substantially vertically on a right portion of the base member 12. The top member 18 is provided on top ends of the rear member 14 and the side members 16L and 16R so as to face the base member 12.

A stamping head 38 and a moving mechanism are provided above the base member 12. The moving mechanism is configured to move the stamping head 38 three dimensionally, more specifically, in an X axis direction, a Y axis direction and a Z axis direction. The moving mechanism will be described later in detail. A securing jig 24 that secures the processing target 200 is detachably attached on a front portion of base member 12. The processing target 200 is secured onto the securing jig 24. In the present preferred embodiment, the processing target 200 preferably is a steel tool for medical uses such as, for example, a clamp, a knife or the like in this preferred embodiment, but many other targets may be used with various preferred embodiments of the present invention.

As shown in FIG. 1, the moving mechanism included in the stamping device 10 includes an elevation member 28, a slidable member 32 and a carriage 36. The elevation member 28 is slidable along guide rails 26*a* and 26*b* extending in the Z axis direction respectively in the vicinity of the side members 16L and 16R. The slidable member 32 is slidable along guide rails 30*a* and 30*b* extending in the Y axis direction below the elevation member 28. The carriage 36 is slidable along guide rails 34*a* and 34*b* extending in the X axis direction between a left member and a right member of the slidable member 32. The stamping head 38 is provided on the carriage 36. A laser pointer 150 is provided on a top surface of the elevation member 28. The laser pointer 150 directs light to a central or substantially central position of an area of a surface 200*a* of the processing target 200 on which stamping is to be performed.

The stamping head 38 includes a processing tool 58 and a holder 60 to which the stamping tool 58 is detachably attached. The processing tool 58 vibrates in the Z axis direction and forms a stamping indentation having a predetermined depth onto the surface 200*a* of the processing target 200. The processing tool 58 is provided above the base member 12. The overall operations including operations of moving the elevation member 28, the slidable member 32 and the carriage 36, a stamping operation performed on the surface 200*a* of the processing target 200 by the stamping head 38 and the like are controlled by a microcomputer 40 described later.

A stepping motor 42 controllable to be driven by the microcomputer 40 is provided on a bottom surface of the top member 18. A Z-axis direction feed screw 44 is connected to the stepping motor 42. A screw shaft of the Z-axis direction feed screw 44 on which a thread is provided extends in the Z axis direction. The screw shaft of the Z-axis direction feed screw 44 rotates about the Z axis direction when the stepping motor 42 is driven. The Z-axis direction feed screw 44 extends through a central or substantially central position of the elevation member 28. A feed nut 46 is provided in a through-hole through which the Z-axis direction feed screw 44 extends. The Z-axis direction feed screw 44 is threaded with the feed nut 46. In such a structure, when the stepping motor 42 is driven, the Z-axis direction feed screw 44 is rotated and thus the elevation member 28 moves upward and downward in the Z axis direction.

A stepping motor 48 controllable to be driven by the microcomputer 40 is provided at a rear end of the elevation member 28. A Y-axis direction feed screw 50 is connected to the stepping motor 48. A screw shaft of the Y-axis direction feed screw 50 on which a thread is provided extends in the Y axis direction. The screw shaft of the Y-axis direction feed screw 50 rotates about the Y axis direction when the stepping motor 48 is driven. The Y-axis direction feed screw 50 extends through a top rear portion of the slidable member 32. A feed nut 52 is provided in a through-hole through which the Y-axis direction feed screw 50 extends. The Y-axis direction feed screw 50 is threaded with the feed nut 52. In such a structure, when the stepping motor 48 is driven, the Y-axis direction feed screw 50 is rotated and thus the slidable member 32 moves forward and rearward in the Y axis direction.

A stepping motor 54 controllable to be driven by the microcomputer 40 is provided on a right front surface of the slidable member 32. An X-axis direction feed screw 56 is connected to the stepping motor 54. A screw shaft of the X-axis direction feed screw 56 on which a thread is provided extends in the X axis direction. The screw shaft of the X-axis direction feed screw 56 rotates about the X axis direction when the stepping motor 54 is driven. The X-axis direction feed screw 56 extends through a side surface of the carriage 36. A feed nut (not shown) is provided in a through-hole through which the X-axis direction feed screw 56 extends. The X-axis direction feed screw 56 is threaded with the feed nut. In such a structure, when the stepping motor 54 is driven, the X-axis direction feed screw 56 is rotated and thus the carriage 36 moves rightward and leftward in the X axis direction. Thus, the carriage 36 is movable three-dimensionally by the stepping motors 42, 48 and 54.

The securing jig 24 is detachably provided on the front portion of the base member 12 and secures the processing target 200. The securing jig 24 has a structure configured to move the secured processing target 200 in the X axis direction and the Y axis direction. A specific structure of the securing jig 24 is disclosed in, for example, Japanese Laid-Open Patent Publication No. 2013-10154 and thus will not be described herein.

Figure 2:
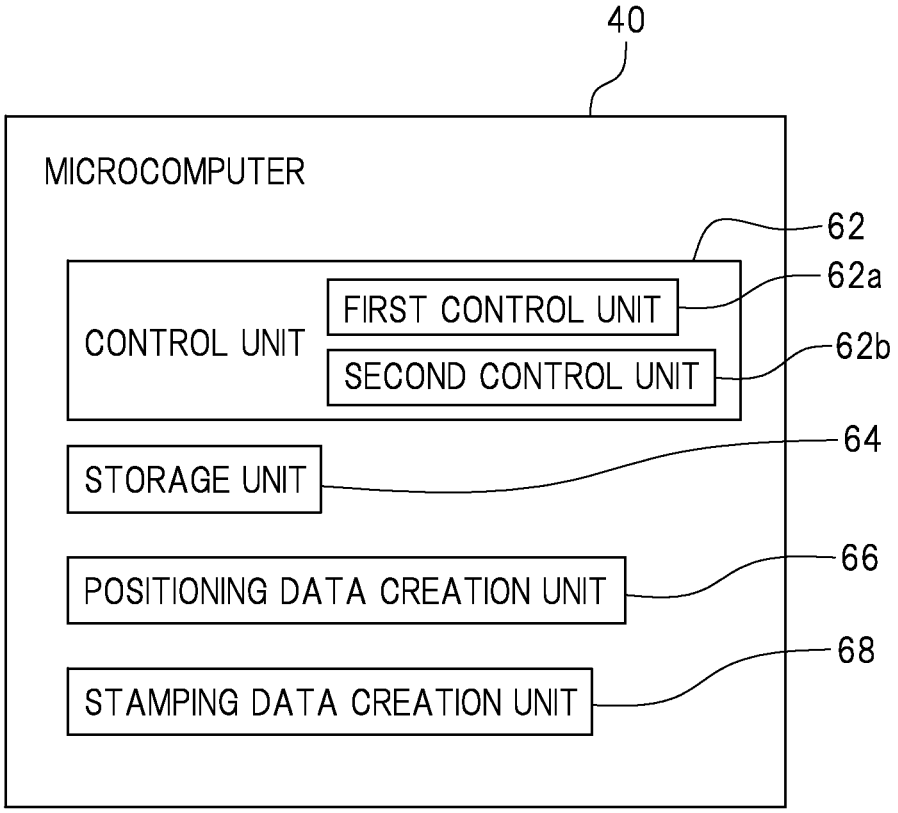
FIG. 2 is a block diagram showing a functional structure of a microcomputer in a preferred embodiment according to the present invention.

Now, with reference to FIG. 2, a functional structure of the microcomputer 40 will be described. The microcomputer 40 is configured or programmed to include a control unit 62, a storage unit 64, a positioning data creation unit 66, and a stamping data creation unit 68. The control unit 62 preferably includes a CPU (central processing unit). The control unit 62 is configured or programmed to include a first control unit 62*a* and a second control unit 62*b*. The first control unit 62*a* and the second control unit 62*b* will be described in detail later. The storage unit 64 may include, for example, a memory. The CPU executes a predetermined program stored in a RAM (random access memory; not shown), so that the positioning data creation unit 66 and the stamping data creation unit 68 are functionally provided.

The control unit 62 executes, via the stepping motors 42, 48 and 54, overall control of various elements of the stamping device 10 such as control of the movements of the elevation member 28, the slidable member 32 and the carriage 36, a control of a stamping force of the stamping head 38 on the surface 200*a* of the processing target 200, and the like. The storage unit 64 stores various data set for the stamping force, the size of a stamp image or the like, image data representing a two-dimensional symbol or the like, stamping data representing the stamp image and the like, and positioning data described later.

The stamping data creation unit 68 creates stamping data usable to perform stamping on the surface 200*a* of the processing target 200, based on the various set data and the image data stored. The positioning data creation unit 66 creates positioning data usable to position the processing target 200, based on the stamping data. The positioning data is stored in the storage unit 64. The positioning data preferably has a capacity that is smaller than that of the stamping data. Therefore, it is not time-consuming or labor-consuming to create the positioning data.

Figure 3A:
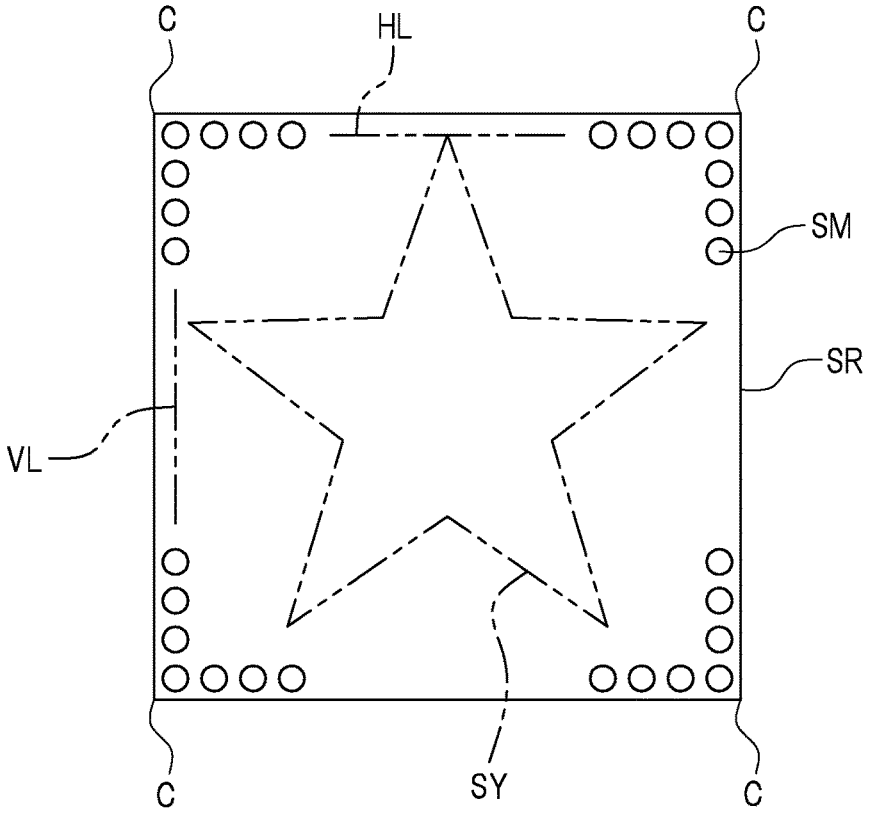
FIG. 3A shows an example of stamping indentations for positioning represented by positioning data in a preferred embodiment according to the present invention.

The positioning data created by the positioning data creation unit 66 is, for example, as follows. As shown in FIG. 3A, the positioning data represents a plurality of stamping indentations SM for positioning. The stamping indentations SM for positioning are located in an area SR where a two-dimensional symbol SY having a star shape or the like, which is an example of a stamp image, is to be formed (hereinafter, this area will be referred to as a "stamping area"). Although the positioning data does not include the stamp image such as the two-dimensional symbol SY or the like, FIG. 3A shows the two-dimensional symbol SY for easier understanding. The stamping area SR may have any of various shapes preferably including a square shape, a rectangular shape, a circular shape, an elliptical shape and the like. In the example shown in FIG. 3A, a plurality of stamping indentations SM for positioning are located at a prescribed interval on each of outermost horizontal lines HL and on each of outermost vertical lines VL of the stamping area SR. This will be described in more detail. A stamping indentation SM for positioning is located at each of four corners C of the stamping area SR. In addition, equal numbers of stamping indentations SM for positioning are located on a horizontal line HL and a vertical line VL extending from each corner C. A total number of the stamping indentation SM for positioning formed at each corner C, the plurality of stamping indentations SM for positioning formed on the horizontal line HL extending from the each corner C, and the plurality of stamping indentations SM for positioning formed on the vertical line VL extending from the each corner C preferably is seven, for example. The positioning data representing the stamping indentations SM for positioning shown in FIG. 3A represents 28 stamping indentations SM for positioning in total.

Figure 5:
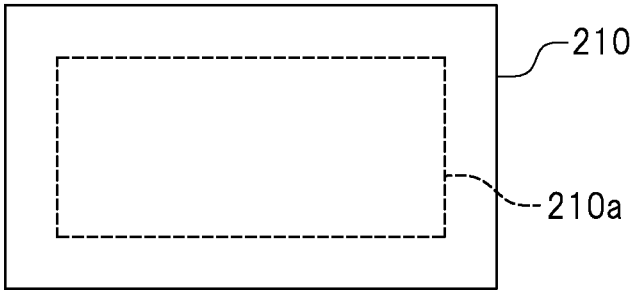
FIG. 5 shows a sheet stamping area of a protective sheet in a preferred embodiment according to the present invention.

In this preferred embodiment, before stamping is performed on the processing target 200 by use of the stamping data, stamping is performed on the processing target 200 including a protective sheet 210 shown in FIG. 1 attached thereto by use of the above-described positioning data. As shown in FIG. 5, the protective sheet 200*a* includes a sheet stamping area 210*a* corresponding to the stamping area SR provided therein. The sheet stamping area 210*a* is visually recognizable, and may be provided by marking or the like. For the protective sheet 210, a transparent adhesive tape formed of, for example, a synthetic resin that is softer than the processing target 200 is preferably used. The protective sheet 210 preferably has a thickness of, for example, about 0.05 mm to about 0.3 mm. The protective sheet 210 is attached to a predetermined area of the processing target 200.

For performing the stamping by use of the positioning data, the first control unit 62*a* controls the processing tool 58 such that the stamping is performed based on the positioning data at a first stamping energy on the processing target 200 in a state of having the protective sheet 210 attached thereto. The stamping at the first stamping energy is performed only on the protective sheet 210, and does not reach the surface 200*a* of the processing target 200 that is below the protective sheet 210. For performing the stamping by use of the stamping data, the second control unit 62*b* controls the processing tool 58 such that the stamping is performed based on the stamping data at a second stamping energy, which is equal to or different from the first stamping energy, on the processing target 200 in a state of having the protective sheet 210 peeled off therefrom. The "stamping energy" refers to a concept encompassing the stamping speed, the stamping force and the stamping stroke (also referred to as the "moving amount of stamping") of the processing tool 58. The stamping speed is lower at the stamping performed by use of the positioning data than at the stamping performed by use of the stamping data. The stamping force is weaker at the stamping performed by use of the positioning data than at the stamping performed by use of the stamping data. The stamping stroke is shorter at the stamping performed by use of the positioning data than at the stamping performed by use of the stamping data. The second stamping energy may be larger than the first stamping energy, the second stamping energy may be equal to the first stamping energy, or the second stamping energy may be smaller than the first stamping energy, depending on the size or the material of the processing target 200. In the case where the protective sheet 210 is preferably made of a synthetic resin adhesive tape as described above, the first stamping energy is a fixed or substantially fixed value.

Hereinafter, a flow of stamping process will be described. For example, a non-limiting example of a method for forming the two-dimensional symbol SY as shown in FIG. 3A on the processing target 200 is as follows. First, various settings regarding the stamping force of the processing tool 58, the size of the two-dimensional symbol SY, which is a stamp image, and the like are performed on the stamping device 10.

Next, the image data representing the two-dimensional symbol SY is stored in the storage unit 64. Then, based on the image data and the various set data stored in the storage unit 64, the stamping data is created by the stamping data creation unit 68. Based on the created stamping data, the positioning data is created by the positioning data creation unit 66.

Next, an operator secures the processing target 200 having the protective sheet 210 attached thereto to the securing jig 24. The position of the processing target 200 secured to the securing jig 24 is finely adjusted such that light from the laser pointer 150 is at a central position of the sheet stamping area 210*a* of the protective sheet 210. When the operator operates an operating element or the like to issue an instruction to perform the stamping for positioning the processing target 200, the control unit 62 controls the operations of the elevation member 28, the slidable member 32, the carriage 36, and the stamping head 38 based on the positioning data stored in the storage unit 64 of the microcomputer 40. The stamping is performed on the protective sheet 210 by using the positioning data. In this case, as described above, the stamping is performed at the first stamping energy under the control of the first control unit 62*a*. Therefore, the stamping indentations for positioning are formed only on the protective sheet 210 and do not reach the surface 200*a* of the processing target 200.

Next, the operator visually checks the stamping indentations for positioning formed on the protective sheet 210.

When the stamping indentations for positioning extend beyond the sheet stamping area 210*a*, the position of the processing target 200 is adjusted by use of the securing jig 24. Then, the operator peels off the protective sheet 210, and attaches a new protective sheet 210. Next, the stamping indentations for positioning are formed on the protective sheet 210 again. This process is repeated until the stamping indentations for positioning are located inside the sheet stamping area 210*a*, in other words, until the stamping indentations for positioning do not extend beyond the sheet stamping area 210*a* anymore.

By contrast, when the stamping indentations for positioning are located inside the sheet stamping area 210*a* without extending beyond the sheet stamping area 210*a*, the operator peels off the protective sheet 210 from the processing target 200. Then, the operator operates an operating element or the like to issue an instruction to perform the stamping. When it is instructed to perform the stamping by the operator, the control unit 62 controls the operations of the elevation member 28, the slidable member 32, the carriage 36, and the stamping head 38 based on the stamping data stored in the storage unit 64 of the microcomputer 40. In this case, as described above, the stamping is performed at the second stamping energy by the control of the second control unit 62*b*. As a result, the stamp image such as, for example, the two-dimensional symbol SY is formed on the surface 200*a* of the processing target 200.

As described above, the stamping device 10 in this preferred embodiment preferably creates the positioning data usable to position the processing target 200 based on the stamping data that is created by use of the image data representing the two-dimensional symbol SY or the like. The processing target 200 including the protective sheet 210 attached thereto is secured to the securing jig 24, and the stamping indentations for positioning are formed at the first stamping energy on the protective sheet 210 attached to the secured processing target 200. When the stamping indentations for positioning formed on the protective sheet 210 extend beyond the sheet stamping area 210*a*, the position of the processing target 200 is adjusted again. After a new protective sheet 210 is attached, the stamping indentations for positioning are formed again on the protective sheet 210. By contrast, when the stamping indentations for positioning formed on the protective sheet 210 are inside the sheet stamping area 210*a*, the stamp image is formed at the second stamping energy on the processing target 200 in a state of having the protective sheet 210 peeled off therefrom. The stamping at the first stamping energy is performed only on the protective sheet 210. Therefore, even when the stamping indentations for positioning extend beyond the sheet stamping area 210*a*, it is only necessary to peel off the protective sheet 210. The process of grinding the stamp image by a grinder or the like, which is conventionally necessary, is not needed. Therefore, even an unexperienced operator is able to perform the stamping more easily and within a shorter time than with a conventional device.

In this preferred embodiment, as shown in FIG. 3A, the plurality of stamping indentations SM for positioning are preferably formed at a plurality of positions inside the stamping area SR. This makes it easy for the operator to check the sheet stamping area 210*a* of the protective sheet 210. Therefore, the operator can easily determine whether or not the stamping indentations SM for positioning formed by use of the positioning data extend beyond the sheet stamping area 210*a*.

The above preferred embodiment may be modified as described in modifications (1) through (8) below.

(1) In the above preferred embodiment, seven stamping indentations SM for positioning in total, for example, preferably are formed at each of the four corners C and on the horizontal and vertical lines extending from the each corner C of the stamping area SR. The present invention is not limited to this. One stamping indentation SM for positioning may be formed at each of the four corners C of the stamping area SR. Alternatively, three, five, nine, or any other odd number of stamping indentations SM for positioning may be formed at each of the four corners C and on the horizontal and vertical lines extending from the each corner C of the stamping area SR. Still alternatively, two, four, six or any other even number of indentations SM for positioning may be formed.

(2) In the above preferred embodiment, the star-shaped two-dimensional symbol SY is preferably used as the stamp image. The present invention is not limited to this. The stamp image may have any other shape, for example, a circular shape, a triangular shape or the like.

(3) In the above preferred embodiment, when the stamping indentations for positioning formed on the protective sheet 210 based on the positioning data extend beyond the sheet stamping area 210*a*, the operator preferably adjusts the position of the processing target 200 on the securing jig 24. The present invention is not limited to this. The moving amount of the slidable member 32, the carriage 36 or the like may be adjusted under the control of the control unit 62 of the microcomputer 40 such that the stamping indentations for positioning are located inside the sheet stamping area 210*a*.

(4) In the above preferred embodiment, the microcomputer preferably creates the stamping data and also creates the positioning data based on the stamping data. The present invention is not limited to this. The stamping data and the positioning data may be created by a separate personal computer. The created stamping data and positioning data may be transferred to the microcomputer 40 by wired or wireless communication, or may be transferred to the microcomputer 40 via a storage medium, for example. The storage medium may be a semiconductor memory such as a ROM or the like, a hard disc, a CD (compact disc), a DVD (digital versatile disc) or the like.

Figure 3B:
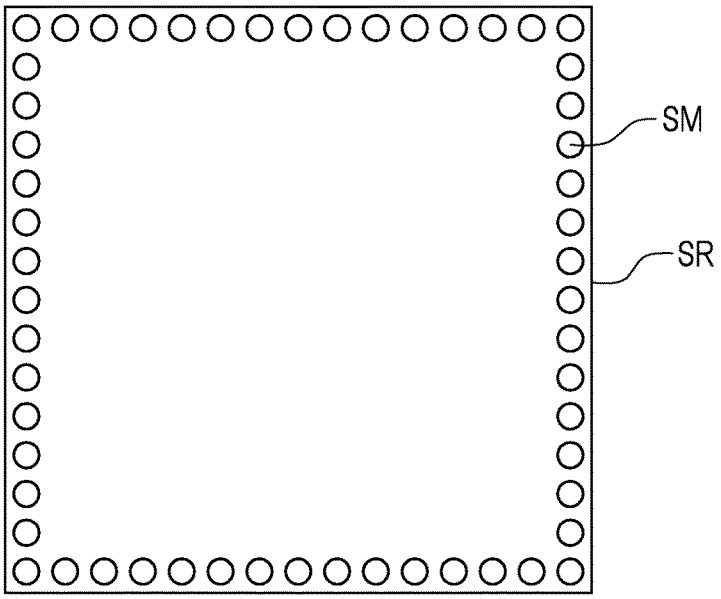
FIG. 3B shows another example of stamping indentations for positioning represented by positioning data in a preferred embodiment according to the present invention.

(5) In the above preferred embodiment, as shown in FIG. 3A, the plurality of stamping indentations SM for positioning preferably are formed in a portion of each horizontal line HL and in a portion of each vertical line VL inside the stamping area SR. The present invention is not limited to this. As shown in FIG. 3B, the stamping indentations SM for positioning may be formed along the entirety of each horizontal line HL and the entirety of each vertical line VL. In FIG. 3B, the horizontal lines HL and the vertical lines VL are omitted for easier understanding.

Figure 4:
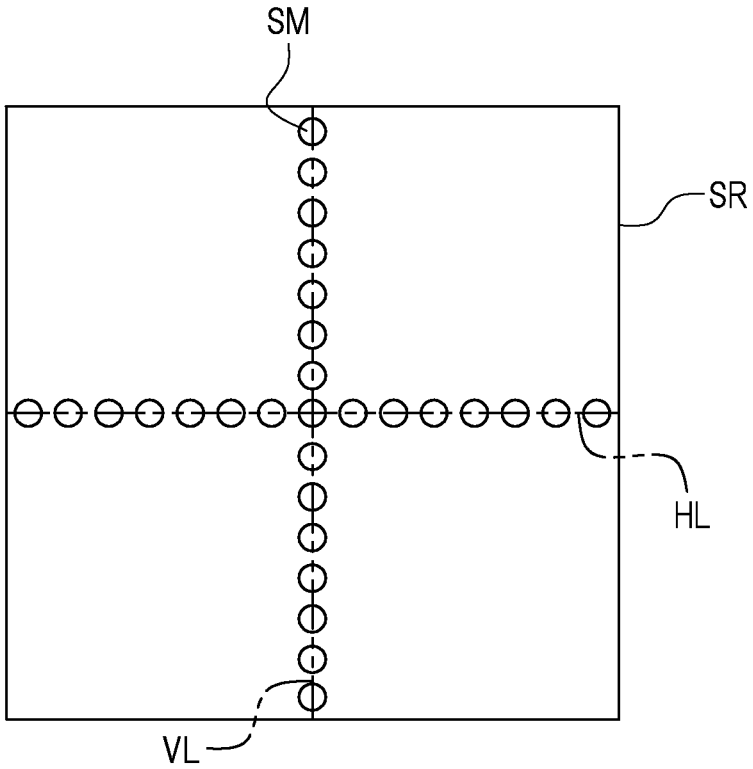
FIG. 4 shows still another example of stamping indentations for positioning represented by positioning data in a preferred embodiment according to the present invention.

(6) In the above, as shown in FIG. 3A and FIG. 3B, the stamping indentations SM for positioning are preferably formed on each of the outermost horizontal lines HL and each of the outermost vertical lines VL of the square stamping area SR. The present invention is not limited to this. For example, as shown in FIG. 4, the plurality of stamping indentations SM for positioning may be formed on a horizontal line HL and also on a vertical line VL passing a center of the stamping area SR.

(7) In the above preferred embodiment, the protective sheet 210 is preferably attached to the processing target 200 before the processing target 200 is secured to the securing jig 24. The present invention is not limited to this. The protective sheet 210 may be attached to the processing target 200 after the processing target 200 is secured to the securing jig 24.

(8) The above preferred embodiment and the modifications described in (1) through (7) above may be combined appropriately.

The terms and expressions used herein are for description only and are not to be interpreted in a limited sense. These terms and expressions should be recognized as not excluding any equivalents to the elements shown and described herein and as allowing any modifications encompassed in the scope of the claims. The present invention may be embodied in many various forms. This disclosure should be regarded as providing preferred embodiments of the principle of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any embodiment including equivalent elements, modifications, deletions, combinations, improvements and/or alterations of various preferred embodiments based on the present disclosure. The elements of each claim should be interpreted broadly based on the terms used in the claim, and should not be limited to any of the preferred embodiments described in this specification or discussed during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A stamping device that performs stamping on a surface of a processing target, the stamping device comprising:

a processing tool movable at least upward and downward;

a protective sheet that is able to be attached to and peeled off from the surface of the processing target;

a table supporting the processing target;

a stamping data generator that generates stamping data to form a stamp image on the surface of the processing target, based on image data corresponding to the stamp image;

a positioning data generator that generates positioning data based on the stamping data, the positioning data indicating a first stamping position of the processing tool; and a controller that controls an operation of the processing tool; wherein the controller includes:

a first controller that controls the processing tool to perform a first stamping located at the first stamping position and at a first stamping energy; and a second controller that controls the processing tool to perform a second stamping based on the stamping data at a second stamping energy which is greater than the first stamping energy;

the first stamping stamps the protective sheet attached to the surface of the processing target, and does not stamp the surface of the processing target; and after the protective sheet is peeled off from the surface of the processing target, the second stamping stamps the stamp image on the surface of the processing target.

2. A stamping device according to claim 1, wherein the positioning data represents a plurality of stamping indentations for positioning on an outermost line of the stamping area.

3. A stamping device according to claim 1, wherein the stamping area is square or rectangular, and the image data represents a two-dimensional symbol that is to be formed in the stamping area;

the stamping data generator generates the stamping data based on the image data representing the two-dimensional symbol; and the positioning data generator generates positioning data representing a plurality of stamping indentations for positioning on a horizontal line in the stamping area and a plurality of stamping indentations for positioning on a vertical line that is vertical to the horizontal line and is in the stamping area.

4. A stamping device according to claim 3, wherein the positioning data generator generates positioning data representing a plurality of stamping indentations for positioning on each of outermost horizontal lines in the stamping area and a plurality of stamping indentations for positioning on each of outermost vertical lines in the stamping area.

5. A stamping device according to claim 4, wherein the positioning data generator generates positioning data representing a stamping indentation for positioning at each of four corners of the stamping area, at least one stamping indentation for positioning on the horizontal line extending from each of the corners and at least one stamping indentation for positioning on the vertical line extending from each of the corners, the at least one stamping indentation for positioning on the horizontal line and the at least one stamping indentation for positioning on the vertical line being of the same number.

6. A stamping device according to claim 5, wherein a total number of the stamping indentation for positioning at each of the corners, the at least one stamping indentation for positioning on the horizontal line extending from the each corner and the at least one stamping indentation for positioning on the vertical line extending from the each corner is seven.

7. A stamping device according to claim 1, wherein the protective sheet is softer than the processing target.

8. A stamping device according to claim 1, wherein the protective sheet is made of a synthetic resin transparent adhesive tape.

9. A stamping device according to claim 1, wherein the processing target is a steel medical tool.

* * * * *